US006101826A

United States Patent [19]

Bessler

[11] Patent Number: 6,101,826

[45] Date of Patent: Aug. 15, 2000

[54] METHOD FOR SELECTION OF REFRIGERATOR CONTROL PARAMETERS

[75] Inventor: Warren Frank Bessler, Amsterdam, N.Y.

[73] Assignee: General Electric Company, Schenectady, N.Y.

[21] Appl. No.: 09/288,917

[22] Filed: Apr. 9, 1999

[51] Int. Cl.[7] ..... F25D 17/04

[52] U.S. Cl. ..... 62/187

[58] Field of Search ..... 62/187, 186, 177, 62/408

[56] References Cited

U.S. PATENT DOCUMENTS

| | | | |
|---|---|---|---|
| 3,793,847 | 2/1974 | Scarlett et al. | 62/190 |
| 5,357,765 | 10/1994 | Thomas et al. | 62/187 |
| 5,375,428 | 12/1994 | LeClear et al. | 62/187 |
| 5,477,699 | 12/1995 | Guess et al. | 62/187 |
| 5,487,277 | 1/1996 | Bessler | 62/187 |
| 5,524,447 | 6/1996 | Shim | 62/209 |
| 5,675,981 | 10/1997 | Lee | 62/187 |

FOREIGN PATENT DOCUMENTS

| | | | |
|---|---|---|---|
| 406137738A | 5/1994 | Japan | 62/187 |

*Primary Examiner*—Henry Bennett
*Assistant Examiner*—Marc Norman
*Attorney, Agent, or Firm*—Patrick K. Patnode; Marvin Snyder

[57] ABSTRACT

An exemplary embodiment of the invention is directed to a method for selecting damper values in a refrigerator. Performance parameters indicating a desired fresh food temperature and desired freezer temperature are obtained for a plurality of control settings. A fresh food temperature variance limit and a freezer temperature variance limit are also obtained. A transfer function for the refrigerator representing performance of the refrigerator at each of said plurality of control settings is determined. A plurality of damper values are determined to minimize deviation from the desired fresh food temperature and the desired freezer temperature for each of said plurality of control settings.

16 Claims, 3 Drawing Sheets

FIG. 1

| Freezer \ Fresh Food | 1 | 5 | 9 |
|---|---|---|---|
| A | 45 / 5 | 38 / 5 | 33 / 5 |
| C | 45 / 0 | 38 / 0 | 33 / 0 |
| E | 45 / -5 | 38 / -5 | 33 / -5 |

FIG. 3

90F ambient — DFSS OPTIMUM FOR DUAL MANUAL DAMPERS

| POINT | IDEAL FR | TFR | TFF | IDEAL FF | DAMPER |
|---|---|---|---|---|---|
| 5A | 5 | 5.2 | 38.2 | 38 | 0.78 |
| 5C | 0 | 0.0 | 38.0 | 38 | 0.58 |
| 5E | -5 | -5.1 | 37.9 | 38 | 0.41 |
| 9A | 5 | 5.9 | 33.9 | 33 | 1.00 |
| 9C | 0 | 0.1 | 33.1 | 33 | 0.80 |
| 9E | -5 | -5.3 | 32.7 | 33 | 0.63 |
| 1A | 5 | 4.6 | 44.6 | 45 | 0.50 |
| 1C | 0 | -0.1 | 44.9 | 45 | 0.29 |
| 1E | -5 | -4.7 | 45.3 | 45 | 0.12 |

OPTIMUM DUAL DAMPER PTS @90F

| FREEZER DAMPER | | FOOD DAMPER | |
|---|---|---|---|
| A | 0.43 | 1 | 0.07 |
| C | 0.22 | 5 | 0.36 |
| E | 0.05 | 9 | 0.57 |

FIG. 4

70F ambient — DFSS OPTIMUM FOR DUAL MANUAL DAMPERS

| POINT | IDEAL FR | TFR | TFF | IDEAL FF | DAMPER |
|---|---|---|---|---|---|
| 5A | 5 | 5.4 | 38.4 | 38 | 0.34 |
| 5C | 0 | 0.4 | 38.4 | 38 | 0.20 |
| 5E | -5 | -5.7 | 37.3 | 38 | 0.20 |
| 9A | 5 | 4.9 | 32.9 | 33 | 1.00 |
| 9C | 0 | -1.7 | 31.3 | 33 | 0.86 |
| 9E | -5 | -8.1 | 29.9 | 33 | 0.86 |
| 1A | 5 | 4.0 | 44.0 | 45 | 0.14 |
| 1C | 0 | -0.7 | 44.3 | 45 | 0.00 |
| 1E | -5 | -6.7 | 43.3 | 45 | 0.00 |

OPTIMUM DUAL DAMPER PTS @70F

| FREEZER DAMPER | | FOOD DAMPER | |
|---|---|---|---|
| A | 0.14 | 1 | 0.00 |
| C | 0.00 | 5 | 0.20 |
| E | 0.00 | 9 | 0.86 |

METHOD FOR SELECTION OF REFRIGERATOR CONTROL PARAMETERS

BACKGROUND OF THE INVENTION

The invention relates to a method for selection of refrigerator control parameters. Refrigerators are expected to operate over a range of ambient temperatures, typically from about 55F. to about 90F. Consumers are supplied two control knobs or other means with which to adjust the fresh food and freezer compartment temperatures. At each combined setting of the control knobs, there is a target set of fresh food and freezer temperatures that an ideal refrigerator should achieve, independent of ambient conditions. Different control hardware and strategies attempt to approximate this ideal performance matrix. It is understood that selection of an optimal control method would enhance refrigerator performance.

Accordingly, there is a need in the art for improved refrigeration control.

BRIEF SUMMARY OF THE INVENTION

An exemplary embodiment of the invention is directed to a method for selecting damper values in a refrigerator. Performance parameters indicating a desired fresh food temperature and desired freezer temperature are obtained for a plurality of control settings. A fresh food temperature variance limit and a freezer temperature variance limit are also obtained. A transfer function for the refrigerator representing performance of the refrigerator at each of said plurality of control settings is determined. A plurality of damper values are determined to minimize deviation from the desired fresh food temperature and the desired freezer temperature for each of said plurality of control settings.

BRIEF DESCRIPTION OF THE DRAWINGS

FIG. 1 is a performance matrix;

FIG. 3 is a table representing a first refrigerator design; and

FIG. 4 is a table representing a second refrigerator design.

DETAILED DESCRIPTION OF THE INVENTION

Figure 2:
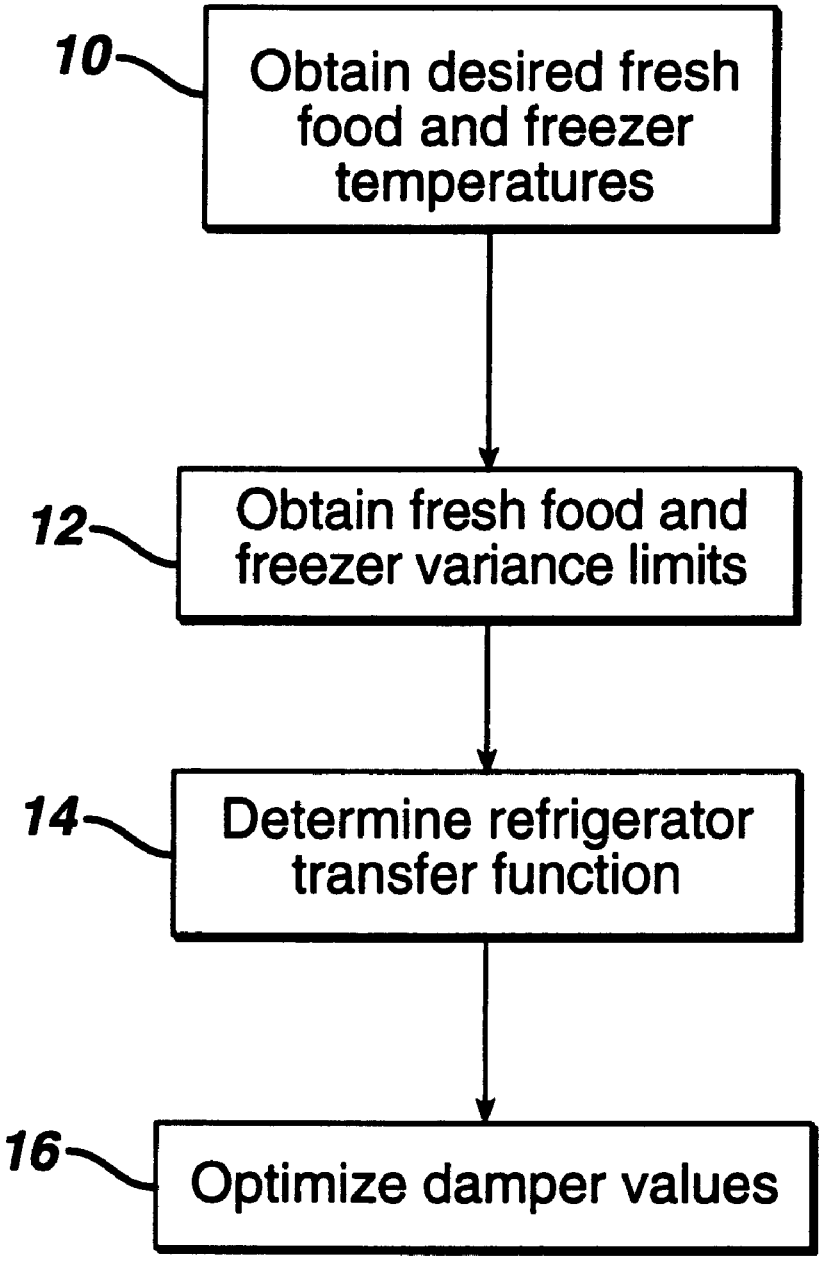
FIG. 2 is a flowchart of a refrigerator design selection process.

Existing refrigerators provide a control for freezer compartment temperature and a control for fresh food compartment temperature. FIG. 1 is a performance matrix depicting the desired fresh food and freezer temperatures for an exemplary refrigerator. As shown in FIG. 1, the freezer setting can vary from A to E, with A being warm and E being cold. In addition, the fresh food setting may vary from 1 to 9 with 1 being warmest and 9 being coolest. Each combination of freezer setting and fresh food setting results in two ideal temperature values. A critical-to-quality analysis based on customer expectations may be performed to provide the ideal temperatures for each combination in the performance matrix. For example, at setting C5, the ideal freezer temperature is 0° F. and the ideal fresh food temperature is 38° F. The nine possible combinations of freezer and fresh food temperature settings yield the nine points of the ideal performance matrix. At each point in the matrix, there is an ideal freezer temperature and an ideal fresh food temperature so that a total of eighteen targets exist. In evaluating control methods, the freezer and fresh food temperatures are compared to these eighteen targets.

A variety of control methods may be used to operate the refrigerator so that the actual operating temperature of the freezer and fresh food areas is close to the ideal operating temperatures. An exemplary embodiment of the invention is a method of comparing control schemes using a single quality metric and optimizing the control parameters available in each scheme so as to maximize the performance of the refrigerator.

An exemplary embodiment of the invention uses the design for six sigma (DFSS) quality approach for ranking alternative refrigerator control schemes with a custom designed scorecard. To evaluate various control methods, a refrigerator model is used as a transfer function to generate a performance map of a particular control method. The inputs to the transfer function (referred to as critical X's) are ambient temperature, fresh food temperature, and the opening of a damper that controls flow of freezer air to the fresh food compartment. In a typical refrigerator, a single compressor provides cold air to the freezer compartment and a damper is used to direct cold air to the fresh food compartment. The outputs of the transfer function (referred to as resultant Y's) are freezer temperature and fraction on time (the percentage of time the compressor is running).

A description of the transfer function will now be provided. For each fresh food target temperature, a logarithmic relationship is developed as $$TFR=a+b*1n(\text{damper setting}) \quad \text{(eq. 1)}$$

The constants a and b depend on ambient temperature. Fraction on time is developed as % run time=c*(damper setting)^d where c and d depend on ambient temperature. The logarithmic functions are combined into one equation at each ambient temperature which takes the second order polynomial form of:

$$TFR=a+b*TFF+c*\text{damp}+d*TFF*\text{damp}+e*TFF\hat{}2+f*\text{damp}\hat{}2 \quad \text{(eq. 2)}$$

where TFR is freezer temperature, TFF is fresh food temperature and damp is the damper value which ranges from 0 (closed) to 1 (open). Variables e and f are also related to ambient temperature.

The freezer temperature error (difference between TFR and TFRdesired) is related to the fresh food error (difference between TFF and TFFdesired) in a normalized fashion as follows:

$$(TFR-TFR\text{desired})/FR\text{spec}=-(TFF-TFF\text{desired})/FF\text{spec} \quad \text{(eq. 3)}$$

where the FRspec and FFspec indicate permitted variance in the freezer temperature and the fresh food temperature. The variance limits may be established using critical-to-quality analysis based on customer expectations. Typically, acceptable variance of the freezer temperature is set at ±5° F. and acceptable variance of the fresh food temperature is set at ±2° F. These can be changed and will influence final Z values, described below, as well as optimization of control parameters.

Temperatures in the transfer function are substituted with $$TFR=TFR\text{desired}+TFR\text{error}, \quad \text{(eq. 4)}$$

and $$TRR=TFF\text{desired}+TFF\text{error}. \quad \text{(eq. 5)}$$

TFFerror is then replaced using $$TFF\text{error}=TFR\text{error}*TFF\text{spec}/TFR\text{spec} \quad \text{(eq. 6)}$$

from the error normalization relationship shown in equation 3. This results in nine quadratic equations relating TFRerror to the damper value, one for each performance matrix point. These equations are solved to generate nine TFRerror values, one for each point in the performance matrix shown in FIG. 1. The error relationship in equation 3 is used to derive the fresh food error from the calculated freezer error. In order to represent the overall refrigerator performance variation for a given set of damper values, the error equations are summed together in a DFSS scorecard indicating the degree of overall error.

The nine quadratic equations may be solved for either a single damper design or dual damper design. In a single damper design, the freezer setting will control the damper value or position. In a dual damper design, both the freezer setting and the fresh food setting will contribute to the damper value. Selection of damper values for a dual damper design will be described, but the method is equally applicable to single damper designs. The refrigerator has two controls, namely a fresh food setting (e.g., 1–9) and a freezer setting (e.g., A–E). Both the fresh food setting and the freezer setting may contribute to the cumulative position of the damper. Each fresh food setting is associated with a respective fresh food damper value. Similarly, each freezer setting is associated with a respective freezer damper value. In order to optimize the refrigerator performance, the total airflow contribution of the fresh food damper values and freezer damper values should be optimized so that the total variation from the ideal performance matrix is minimized as described herein.

An overall system performance level, represented by the variable Z, is generated for each proposed control method. In addition, individual values for the fresh food and freezer performance may be generated. The overall Z value is defined by $$Z=(1-\text{mean Error})/STDEV\ \text{Error} \quad \text{(eq. 6)}$$

where Error is the normalized errors of both TFR error/TFR spec and TFF error/TFF spec. The are typically eighteen errors, nine freezer errors and nine fresh food errors, with the freezer error at each target having the opposite sign of its fresh food counterpart. Knowing the performance of a proposed design or tested refrigerator, a single quality Z can be determined using this method. Maximizing the Z value minimizes the deviation from the desired fresh food and desired freezer temperatures in the performance matrix.

At each point in the control matrix, the sum of the fresh food damper value and the freezer damper value will equal the damper value used in the refrigerator transfer function. Proper selection of the three fresh food damper values and the three freezer damper values will maximize the overall system Z. The nine quadratic equations can be solved by the user entering three fresh food and three freezer damper values and observing the effect on the system Z value (i.e., trial and error). Alternatively, and preferably, a solver function (such as an EXCEL solver function), is used so that overall Z is automatically maximized by having the solver function optimize the selection of the three fresh food damper values and the three freezer damper values constrained within 0 (closed) to 1 (full open). The optimization may be performed without constraining the fresh food and freezer damper values to values within 0 to 1. This would indicate that the physical refrigerator design may need to be altered. For example, if the unconstrained optimization yields a damper value of 1.1, this indicates that more cool air is needed to flow to the fresh food area and a larger damper or increased flow rate may be needed.

As noted above, the method may also be applied to single damper designs. in this scenario, the solver optimizes three freezer damper values to minimize the sum eighteen error values (nine fresh food errors and nine freezer errors) and thereby maximizing the overall Z value of the refrigerator. This minimizes the deviation from the desired fresh food and desired freezer temperatures in the performance matrix.

FIG. 2 is a flowchart of the overall process for selecting a refrigerator design. The process begins by obtaining the fresh food and freezer performance parameters such as those shown in FIG. 1. As described above, the performance parameters specify the desired temperature for the fresh food and freezer compartments for different fresh food and freezer settings. At step 12, the variance limits for the freezer temperature and the fresh food temperature are obtained. The variance limits (FFspec and FRspec) allow the temperature error in the fresh food compartment and the freezer compartment to be normalized and thus more easily related to each other. At step 14, the refrigerator transfer function is determined which represents the refrigerator performance for each combination of performance parameters (e.g., each point of the performance matrix). In an exemplary embodiment, the refrigerator transfer function corresponds to the nine quadratic equations described above. At step 16, the refrigerator damper values are optimized to minimize deviation from the ideal temperature values in the performance matrix. Step 16 may generate three damper values in a single damper design or six damper values in a dual damper design (three fresh food damper values and three freezer damper values).

FIGS. 3 and 4 are tables indicating refrigerator designs optimized using an embodiment of the invention. FIG. 3 depicts a dual damper refrigerator design for a 90° F. ambient condition. The columns labeled POINT, IDEAL FR and IDEAL FF are values taken from the performance matrix of FIG. 1. The column labeled DAMPER includes the damper values computed using the nine quadratic equations described above. The TFR and TFF columns represent the predicted freezer temperature and the fresh food temperature derived using the damper values DAMPER in the refrigerator transfer function. At the right side of the table are the three fresh food damper values and three freezer damper values. The sum of the fresh food damper value and the freezer damper value at each control setting is approximately equal to the DAMPER value for that setting. For example, at control setting 5C, the DAMPER value is 0.58 which is equal to the sum of the fresh food damper value at setting 5 (0.36) and the freezer damper value at setting C (0.22). FIG. 4 depicts a dual damper refrigerator design for a 70° F. ambient condition. The optimization performed by an embodiment of the invention for a dual damper design achieves a system Z of 5.4, compared to Z of 3.79 with traditional damper choices.

The present invention can be embodied in the form of computer-implemented processes and apparatuses for practicing those processes. The present invention can also be embodied in the form of computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention can also be embodied in the form of computer program code, for example, whether stored in a storage medium, loaded into or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for selecting damper values in a refrigerator, the method comprising:

obtaining performance parameters indicating a desired fresh food temperature and a desired freezer temperature for a plurality of control settings;

obtaining a fresh food temperature variance limit and a freezer temperature variance limit;

determining a transfer function for the refrigerator representing performance of the refrigerator at each of said plurality of control settings; and determining a plurality of damper values to minimize deviation from the desired-fresh food temperature and the desired freezer temperature for each of said plurality of control settings.

2. The method of claim 1 wherein:

each of said damper values corresponds to one of said control settings; and each of said damper values being approximately equal to a sum of a fresh food damper value and a freezer damper value.

3. The method of claim 1 further comprising:

determining a fresh food temperature error and a freezer temperature error;

wherein said determining a plurality of damper values is responsive to said fresh food temperature error and said freezer temperature error.

4. The method of claim 3 wherein:

said fresh food temperature error is a normalized fresh food temperature error equal to a difference between a predicted fresh food temperature and said desired fresh food temperature divided by said fresh food variance limit.

5. The method of claim 3 wherein:

said freezer temperature error is a normalized freezer temperature error equal to a difference between a predicted freezer temperature and said desired freezer temperature divided by said freezer variance limit.

6. The method of claim 4 wherein:

said freezer temperature error is a normalized freezer temperature error equal to a difference between a predicted freezer temperature and said desired freezer temperature divided by said freezer variance limit.

7. The method of claim 6 wherein:

said determining a plurality of fresh food damper values and freezer damper values is based on maximizing $$Z=(1-\text{mean Error})/STDEV\ \text{Error}$$

where mean Error is the average of the normalized fresh food temperature error and the normalized freezer temperature error and STDEV Error is the standard deviation of the normalized fresh food temperature error and the normalized freezer temperature error.

8. The method of claim 1 wherein:

said damper values are constrained to predefined limits.

9. A storage medium encoded with machine-readable computer program code for selecting damper values in a refrigerator, the storage medium including instructions for causing a computer to implement a method comprising:

obtaining performance parameters indicating a desired fresh food temperature and a desired freezer temperature for a plurality of control settings;

obtaining a fresh food temperature variance limit and a freezer temperature variance limit;

determining a transfer function for the refrigerator representing performance of the refrigerator at each of said plurality of control settings; and determining a plurality of damper values to minimize deviation from the desired fresh food-temperature and the desired freezer temperature for each of said plurality of control settings.

10. The storage medium of claim 9 wherein:

each of said damper values corresponds to one of said control settings; and each of said damper values being approximately equal to a sum of a fresh food damper value and a freezer damper value.

11. The storage medium of claim 9 further comprising instructions for causing a computer to implement:

determining a fresh food temperature error and a freezer temperature error;

wherein said determining a plurality of damper values is responsive to said fresh food temperature error and said freezer temperature error.

12. The storage medium of claim 11 wherein:

said fresh food temperature error is a normalized fresh food temperature error equal to a difference between a predicted fresh food temperature and said desired fresh food temperature divided by said fresh food variance limit.

13. The storage medium of claim 11 wherein:

said freezer temperature error is a normalized freezer temperature error equal to a difference between a predicted freezer temperature and said desired freezer temperature divided by said freezer variance limit.

14. The storage medium of claim 12 wherein:

said freezer temperature error is a normalized freezer temperature error equal to a difference between a predicted freezer temperature and said desired freezer temperature divided by said freezer variance limit.

15. The storage medium of claim 14 wherein:

said determining a plurality of fresh food damper values and freezer damper values is based on maximizing $$Z=(1-\text{mean Error})/STDEV\ \text{Error}$$

where mean Error is the average of the normalized fresh food temperature error and the normalized freezer temperature error and STDEV Error is the standard deviation of the normalized fresh food temperature error and the normalized freezer temperature error.

16. The storage medium of claim 9 wherein:

said damper values are constrained to predefined limits.

* * * * *